US008235338B1

(12) United States Patent
Henry

(10) Patent No.: US 8,235,338 B1
(45) Date of Patent: Aug. 7, 2012

(54) SWING SUPPORT CONNECTOR

(75) Inventor: Brian Henry, Fort Payne, AL (US)

(73) Assignee: PlayCore, Chattanooga, TN (US)

( * ) Notice: Subject to any disclaimer, the term of this patent is extended or adjusted under 35 U.S.C. 154(b) by 880 days.

(21) Appl. No.: 12/112,109

(22) Filed: Apr. 30, 2008

(51) Int. Cl.
*A47B 96/06* (2006.01)

(52) U.S. Cl. ..... 248/214; 403/217; 403/170; 403/295; 472/118

(58) Field of Classification Search ..... 248/214; 403/170, 217, 295; 472/118
See application file for complete search history.

(56) References Cited

U.S. PATENT DOCUMENTS

| | | | | | |
|---|---|---|---|---|---|
| 2,171,681 | A * | 9/1939 | Burke | 403/176 |
| 2,603,272 | A * | 7/1952 | Rowand | 5/130 |
| 2,885,233 | A * | 5/1959 | Horowitz | 403/170 |
| 3,427,024 | A * | 2/1969 | Cross | 472/120 |
| 3,503,582 | A * | 3/1970 | Boucher | 248/370 |
| 3,881,830 | A * | 5/1975 | Kato et al. | 403/171 |
| 4,094,503 | A * | 6/1978 | Wormser | 472/118 |
| 4,190,283 | A * | 2/1980 | Boucher | 297/77 |
| 4,256,300 | A * | 3/1981 | Boucher | 472/118 |
| 4,285,609 | A * | 8/1981 | Runyon | 403/172 |
| 4,569,165 | A * | 2/1986 | Baker et al. | 52/81.3 |
| 4,864,795 | A * | 9/1989 | Burg | 52/646 |
| 5,421,666 | A * | 6/1995 | Spears | 403/176 |
| D364,554 | S * | 11/1995 | Seo | D8/382 |
| 6,413,004 | B1 * | 7/2002 | Lin | 403/176 |
| 6,834,891 | B2 * | 12/2004 | Matsubara et al. | 285/319 |
| 2002/0130514 | A1 * | 9/2002 | Binoder | 285/80 |
| 2005/0176557 | A1 * | 8/2005 | Bork et al. | 482/35 |

* cited by examiner

*Primary Examiner* — Terrell McKinnon
*Assistant Examiner* — Daniel J Breslin
(74) *Attorney, Agent, or Firm* — Stephen J. Stark; Miller & Martin PLLC

(57) ABSTRACT

A swing set assembly having a swing set connector connected to a top rail is preferably provided which has a first cantilevered arm which connects to a top rail of at least two outer perimeters. Top rails are envisioned either fitting over the arm or in a bore the arm depending upon the outer perimeter of the top rail utilized. These and other embodiments are envisioned being of modular construction of a first half and a second half whether at an end of or between top rails. On the event that modification of the swing set is desired, an end half can be removed from a first half, and a top rail half connected thereto along with another top rail to extend the length of the total swing set. Alternatively, if a total top rail length is to be shortened, a top rail can be removed and a first half of the connector can be replaced with an end half.

17 Claims, 4 Drawing Sheets

SWING SUPPORT CONNECTOR

FIELD OF THE INVENTION

The present invention relates to connectors for use in joining top rails utilized with swing sets to top rails and support legs, and more particularly, to a support connector configured to cooperate with at least two different sized top rails and/or, at least in some instances, being modularly constructed for at least one application so that end supports may be replaced, or utilized, with additional top rail members without a need to replace the entirety of a support connector.

BACKGROUND OF THE INVENTION

In the manufacture of swing sets, a top rail is utilized to connect swings thereto, normally with a set of brackets with chains, depending downwardly therefrom which usually connect to a seat. This top rail is normally connected to supports such as pairs of front and rear supports which are respectively directed towards the front and the back and possibly additional supports at each end.

However, prior art connectors utilized to connect supports to end supports and/or front and back supports to the top rail have, in the past, been provided so that the are sized to cooperate with particular size top rails having a specified single outer diameter. Furthermore, there is not believed to be an ability to utilize selected portions of the connectors with other portions so as to cooperate with an existing swing set to install an additional top rail member or alternatively an end support.

Accordingly, improved connectors for connecting supports to the top rails and method of their use are believed to be necessary for swing systems.

SUMMARY OF THE INVENTION

It is an object of at least one embodiment of the present invention to provide a swing set support and top rail connector which cooperates and connects with at least two outer perimeter top rails.

It is another object of at least one embodiment of the present invention to provide a top rail support connector modularly constructed wherein interchangeable components can be utilized to cooperate with the top rails and/or end supports.

It is another object of at least some embodiments of the present invention to provide cast components for use with a swing set connectors for use with top rail support connections.

It is another object of the present invention to provide an improved swing set connector.

In accordance with a presently preferred embodiment of the present invention, a swing set connector is preferably provided which has a first portion which connects to a top rail of at least two outer perimeters. In this embodiment, a cantilevered arm extending from one side of the connector preferably provides an inner diameter slightly greater than a first outer diameter of a first top rail for connection thereto and an outer diameter being slightly smaller than an inner diameter of a second top rail for connection thereto. Which of the two top rails are connected to the arm may depend upon the anticipated loading, by the length of the top rail, and/or anticipated loading of swings connected to the top rail.

The connector is preferably cast or otherwise provided in halves such as could be provided out of metal such as aluminum or other satisfactory material. If a top rail is to be attached to the other side of the connector, then a similar half may be connected to the first half and then front and back supports connected thereto. The halves also cooperate to provide front and rear support bores which receive the front and rear supports in the preferred embodiment. In the event an end support is to be connected to the other side of the top rail, then a second end support half may be connected to the first half and an appropriate end support connected downwardly and or away and at least eventually downwardly therefrom.

In an embodiment utilizing modular construction of the first half and the second half whether at an end of or between top rails, in the event that modification of the swing set is determined to be desirable, an end half can be removed from a first half, if desired, and a top rail half connected thereto along with another top rail to extend the length of the total swing set. Once a final length is determined, at the last set of front and back supports, the or an end half can be connected to a first half, which can be reused from the end half initially removed or replaced with a new end half. Alternatively, if a total top rail length is shortened, a top rail can be removed and the first half of the connector can be replaced with an end half. This style construction is believed to provide an advantage of allowing for length adjustment of swing sets. By selling two first halves as a pair with a top rail and possibly front and back supports, parts currently in use can be utilized as would be understood by one of ordinary skill in the art in an appropriate manner.

BRIEF DESCRIPTION OF THE DRAWINGS

The particular features and advantages of the invention as well as other objects will become apparent from the following description taken in connection with the accompanying drawings in which.

DETAILED DESCRIPTION OF THE PREFERRED EMBODIMENT

Figure 1:
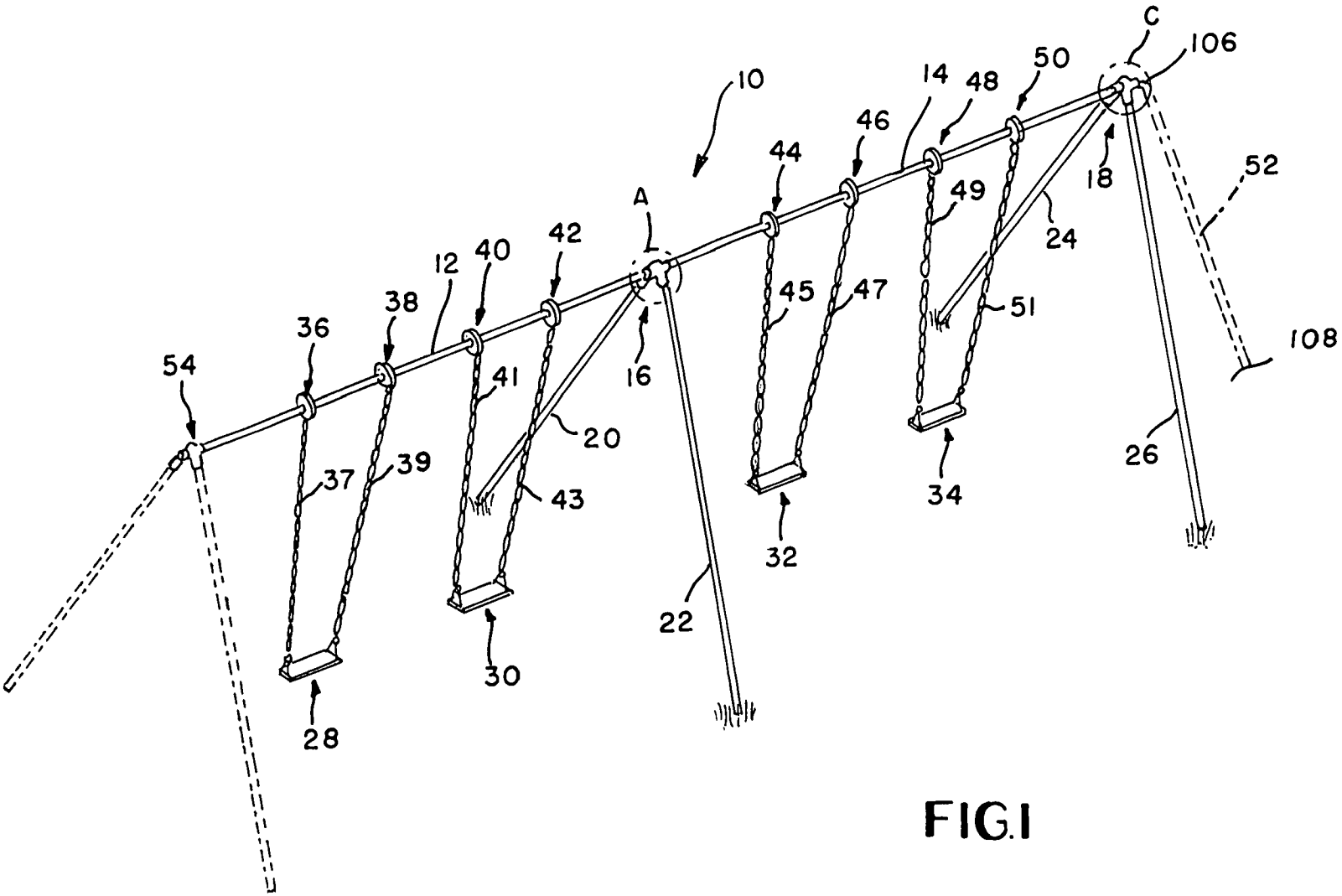
FIG. 1 is a top perspective view of a swing assembly in accordance with the presently preferred embodiment of the present invention.
Figure 3:
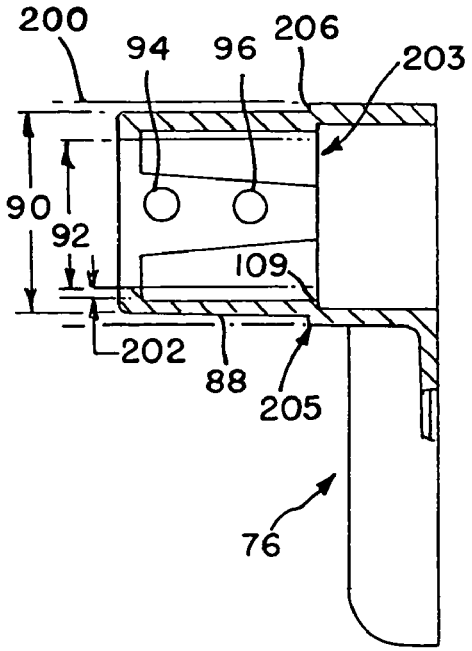
FIG. 3 is a cross-sectional view taken along the line B-B in FIG. 2.
Figure 4:
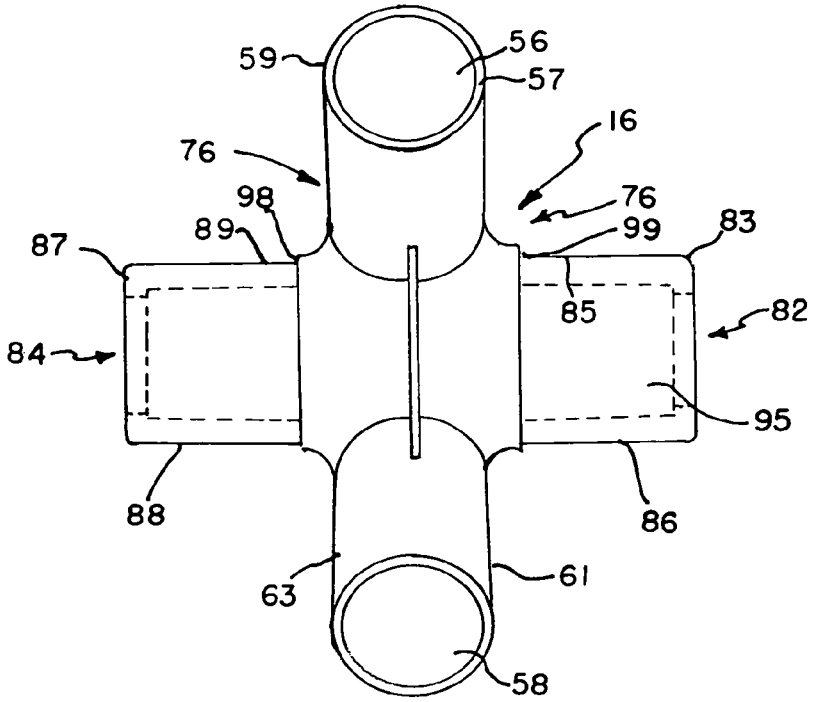
FIG. 4 is a bottom plan view of the connector of FIGS. 2 and 3 with a portion of the internal part shown in phantom.

FIG. 1 shows a swing assembly 10 of a presently preferred embodiment of the present invention. Specifically, top rails 12 and 14 are connected with connector 16 a portion of which is shown in detail in FIG. 2. Connector 16 is also shown in FIG. 4 as well as portions of which are also shown in FIG. 3.

Figure 5:
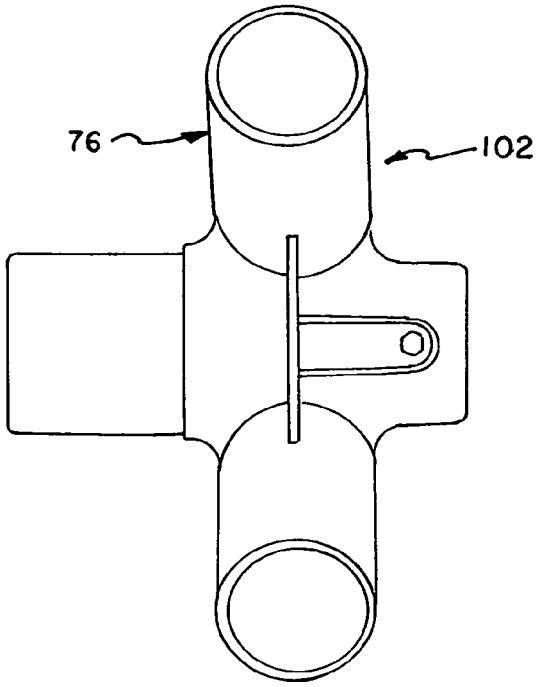
FIG. 5 is a detailed bottom plan view of the connector identified as C in FIG. 1.
Figure 6:
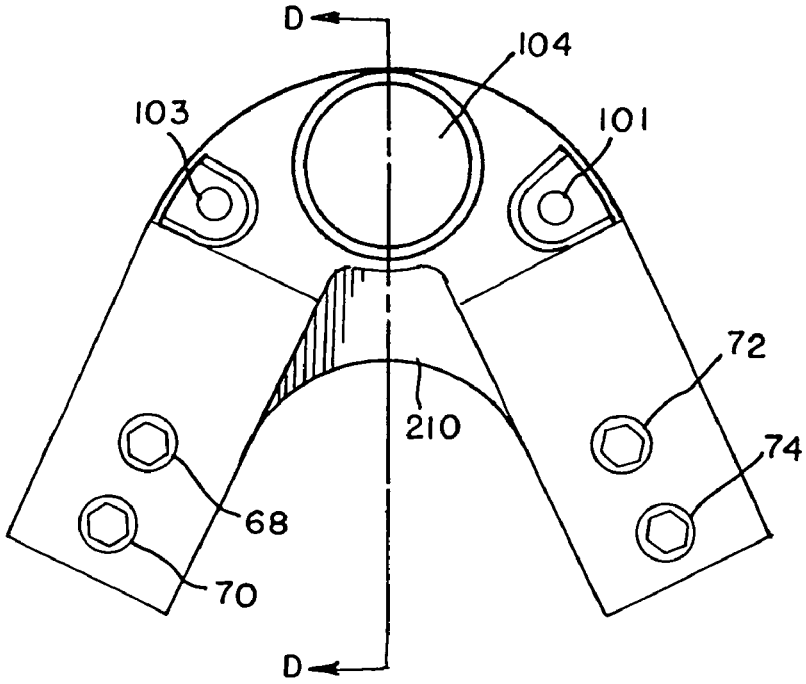
FIG. 6 is a front plan view of the right hand side of the connector shown in FIG. 5.
Figure 7:
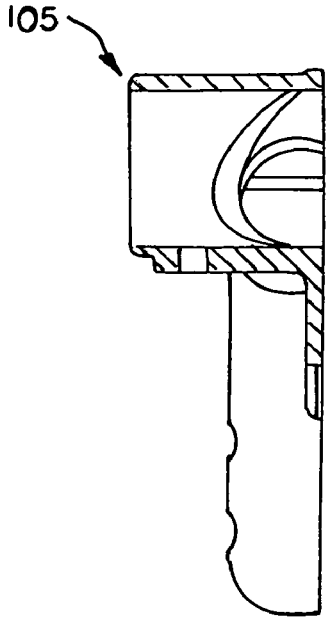
FIG. 7 is a cross-sectional view taken along line D-D in FIG. 6.

Connector 18 is located opposite top rail 14 from connector 16 and is shown in detail in FIG. 5 with portions of that connector being also shown in FIGS. 6 and 7. Connectors 16 and 18 are illustrated connecting to front and back supports 20,22 and 24,26 respectively. From top rails 12,14 depend swings 28,30,32,34 which in this embodiment are connected by brackets 36,38,40,42,44,46,48,50 connected to chains 37,39,41,43,45,47,49,51.

Although only one end support 52 is illustrated which is shown in phantom, it will be obvious to those of ordinary skill in the art that a similar connector 18 as shown in FIG. 1 and FIG. 5 can be turned 180° and provided as connector 54 or instead of connector 16, if only one top rail 14 were utilized as could occur in some embodiments. Of course, although two top rails 12 and 14 are illustrated, more than two top rails could be utilized with additional connectors 16 as will be explained in further detail below.

Figure 2:
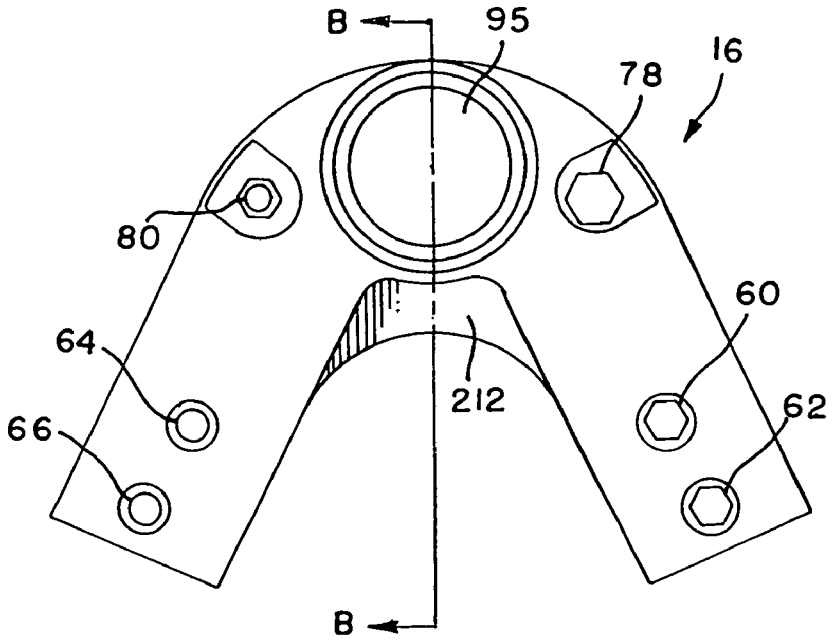
FIG. 2 is a detailed plan view of a portion of the connector identified as A shown in FIG. 1.

FIG. 2 shows a front view of connector 16 of a presently preferred embodiment of the present invention. Front support 20 and rear support 22 preferably have an end portion placed within bores 56,58 as is shown in FIGS. 1 and 4. Once an end of front and roof support 20,22 are inserted within bores 56,58, connectors such as bolts 60,62 can be provided through receivers 64,66 as shown in FIG. 2 and connected with nuts somewhat akin to the nuts 68 and 70 shown in receivers 72,74 on FIG. 6. The nuts and connectors are not shown for receiver 64,66 for purposes of clarity of the figures, but would be understood by those of ordinary skill in the art. The front and rear supports 20,22 may have bores provided therethrough which would accommodate a diameter of the bolts 60,62 if so utilized. Other embodiments may utilize other connectors and/or connection mechanisms and portions.

In addition to receiving front and rear supports 20,22, connector(s) 16 also preferably receives first and second top rails 12,14. One of the features of a presently preferred embodiment of connector 16 which is believed to distinguish other connectors is an ability to receive at least one of two different perimeter top rails. Specifically, first half 76 is illustrated connected to a corresponding first half 76 to provide connector 16 shown in FIG. 4. First half 76 can be integrally formed such as by casting or otherwise formed. Bolt 78 and nut 80 can be utilized to maintain the two halves together as they are shown in FIG. 2.

With a connector 16 assembled, in the preferred embodiment, one of two different sized top rails 12,14 may be installed on either end 82,84 of connector 16. Specifically, arms 86 and 88 may function as either a male or female connection with a top rail 12,14 which is anticipated to be a pipe conduit of known thickness in a presently preferred embodiment although other cross-sectional configurations could be utilized in other embodiments. By utilizing pipe cylinder cross sections of a known relatively constant thickness, an inner diameter of pipe be guided over to be received over outer perimeter having diameter 90 of arm 86 or 88 as illustrated. If utilizing a smaller diameter pipe, an outer perimeter with diameter of top rail 12,14 should be smaller than inner diameter 92 of bore 95 of arm 86,88. Other rail and arm 86,88 cross sections need not necessarily be round as illustrated.

Connection portions illustrated as bores 94,96 are useful in securely connecting the top rails 12,14 to the first connector half 76 and more specifically, arm 88 regardless of whether a larger diameter or a smaller diameter top rail 12,14 is utilized. One skilled in the art will see the connection may be similar or dissimilar to connection of connectors such as bolts 60,62 through bores 94,96 with corresponding nuts 68,70. Other connection mechanisms may be utilized in other embodiments.

Bores 56,58 are front receiving bore 58 and rear receiving bore 56, respectively as illustrated. Front receiving bore 58 is at least partially defined by first forward sleeve portion 57 and preferably by second forward sleeve portion 59 which can cooperate to form forward support receiving bore 58 which preferably extends downwardly relative to first cantilevered arm 86. Rear support receiving bore 56 may or may not be similarly constructed such as with first rear sleeve portion 61 and second rear sleeve portion 63 which preferably extends downwardly relative to second cantilevered arm 88.

Cantilevered arms 86,88 preferably have ends 82,84 respectively. At ends 82 are first outer perimeters at locale 83 and second outer perimeter at locale 85. Locale 85 is illustrated by shoulder 99 which is disposed inwardly of or away from first outer perimeter at end 82. At end 84 are first outer perimeter of locale 87 and second outer perimeter at locale 89. Locale 89 is illustrated by shoulder 98 which is disposed inwardly of or away from first outer perimeter at end 89. The connection portions illustrated as bores 94 and/or 96 are illustrated disposed intermediate first and second outer perimeters of each of the arms 86,88 in the preferred embodiment.

Inside end 82 is bore 95 which has a first inner perimeter at end 82 (locale 83) and a second inner perimeter at locale 85. Second end can be similarly constructed as illustrated. Bore 95 extends through at least a portion of arm 86 as illustrated.

Bores 94,96 providing at least one connection portion are disposed along the arms 86,88 intermediate the first and second outer perimeters as well as first and second inner perimeters as illustrated. Bores 94,96 or other connection portions can be utilized to at least assist in connecting to one of a first or a second top rail having at least two different outer perimeters at an end of the top rail.

First top rail 200 is shown in phantom in FIG. 3 with larger outer perimeter. End 205 contacts shoulder 98. Second top rail 202 is shown in phantom in FIG. 3 with smaller outer perimeter. End 203 is shown contacting stop 205. When end 205 contacts shoulder 98 an at least substantially continuous outer surface 206 may be provided at least in some embodiments.

In the presently preferred embodiment, rails 12,14 having an outer diameter of 2⅜" or 3½" are utilized although in other embodiments, different diameter rails can be utilized with the arms 86,88 of the connector 16. It is anticipated at least for some embodiments that the end of top rail will contact shoulder 98 when extended over arm 88 and/or contact stop 100 if installed internal to arm 88.

In a presently preferred embodiment, two first halves 76 are utilized together for construction of connector 16. They are preferably detachably connected together such as with connectors through corresponding bores 101,103 as illustrated or otherwise such as could be somewhat similar to rail and/or support connections as described above. This allows a swing assembly 10 such as shown in FIG. 1 to be relatively easily converted into a swing assembly having a different number of top rails 12,14. Specifically, if the swings became more popular and additional rails are deemed advisable, then a connector such as connector 18 shown in FIG. 5 having a first half 76 and a second half 102 illustrated with third cantilevered arm 105 can have the second half 102 removed and another first half 76 connected thereto. Another top rail as would be understood by those of ordinary skill in the art can be connected to the new first half 76. Second half 102 may be similarly or dissimilarly constructed relative to first half 76 but in a presently preferred embodiment, second half 102 is slightly different in that a single diameter end support 52 is contemplated being received within bore 104 shown in FIG. 6 such as one with a 2⅜" outer diameter. Of course, other embodiments may have different dimensions and/or capabilities.

The end rail may have bend 106 as illustrated in FIG. 1 so that it can extend initially parallel and collinearly to the top rail 14 and then downwardly depend down to a play surface 108 above which the swings 28,30,32,34 are disposed thereabove.

The wall thickness of the top rails 12,14 as well as supports 20,22,24,26 and end support 52 may or may not be 8 or 13 gauge or otherwise or other suitable dimension. In the applicant's embodiment, the connectors 16 and 18 are cast aluminum which is not believed to have been utilized in prior art construction. However, after significant engineering, these illustrated designs have achieved a safety factor of 5 and do not create unsightly rust issues as iron often does over time. Coated iron like galvanized iron or other product could certainly be utilized in other embodiments. Gussets 210,212 are provided which can provide structural integrity for first halves 76 and/or second halves 102. When cast as halves 76,102, the component parts of each half are integral. Gussets 210,212 as illustrated are adjacent when connected as halves.

Just like the swing set assembly 10 can be extended in length with additional rails 12,14, other swing set assemblies 10 can be shortened. For instance, if rail 14 were removed, then the second half 102 of connector 18 could be removed and replace the first half second 76 disposed towards connector 18 as shown in FIG. 1 with the second half 102. The end support 52 could be connected to depend therefrom towards the playing surface 108 for lateral stability.

Accordingly, at least with some embodiments, a rather ingenious design including cooperating halves such as first half 76 either with a corresponding first half 76 or with a second half 102 is provided. Swing set assembly 10 can take a number of forms in practice. Furthermore, when desiring to expand the swing set assembly 10 for some embodiments, one only needs to order an additional connector 16 and match one of the first half 76 of that connector 16 with an existing first half 76 and then match the other first half 76 with the second half 102 which was mostly likely previously utilized in the existing swing set assembly 10. Alternatively, a new second half 102 could be utilized. It is further envisioned that some swing set assemblies may have top rails 12,14 of differing dimensions and/or that when buying a new connector 16, options may include receiving a top rail 14 and/or front and rear supports 20,22 with the new connector first halves 76 forming connector 16 such as in a kit form or otherwise.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A swing set connector in combination with a top rail comprising:

a swing set connector having a first cantilevered arm having an outer surface with a first outer perimeter at an end, and a second outer perimeter inwardly disposed away from the end, and a bore extending into the first arm from the end through at least a portion of the arm, said bore having an inner surface with a first inner perimeter at the end and a second inner perimeter inwardly disposed away from the end;

a first connection bore engageable intermediate the first and second outer perimeters along the outer surface of the first arm extending through the arm to a location intermediate the first and second inner perimeters along theinner surface of first arm;

a forward support receiving bore defined at least partially by a first forward sleeve portion, said forward support receiving bore connected to the first arm and extending downwardly relative to the first arm;

a rear support receiving bore defined at least partially by a first rear sleeve portion, said rear support receiving bore connected to the first arm and extending downwardly relative to the first arm;

and a first top rail selected from first and second options, said first top rail having an outer perimeter and a bore at an end with an inner perimeter and a second connection bore extending through inner to the outer perimeter near the end, with one of (a) the inner perimeter of the top rail received over at least a portion of the first arm and connected to the first arm with the first connection bore the second connection bore aligned and assisting in connecting the top rail to the first arm when installed with the first option and (b) the outer perimeter of the top rail received in at least a portion of the bore and connected to the first arm with the first connection bore and the second connection bore aligned and assisting in connecting the top rail to the first arm when installed with the second option; wherein said top rail has a swing connected to and depending therefrom.

2. The swing set connector and top rail combination of claim 1 further comprising a shoulder of the first arm at the second perimeter and an outer perimeter of the top rail provide a substantially continuous outer surface.

3. The swing set connector and top rail combination of claim 1 further comprising at least one of an inner stop by the second perimeter which contacts the end of the top rail when the top rail is received in the at least the portion of the bore of the first arm and a shoulder extending radially outwardly by the second outer perimeter of the first arm which contacts the end of the first top rail in an installed configuration.

4. The swing set connector and top rail combination of claim 1 further comprising a first gusset connecting the first forward sleeve portion to the first rear sleeve portion.

5. The swing set connector and top rail combination of claim 4 wherein said first forward sleeve portion and said first rear sleeve portion are integrally connected to the first arm.

6. The swing set connector and top rail combination of claim 5 wherein the swing set connector further comprises a second cantilevered arm opposite the first cantilevered arm, the second arm having a first outer perimeter at an end, a second outer perimeter inwardly disposed away from the end, and a bore extending into the second arm from the end through at least a portion of the second arm, said bore having a first inner perimeter at the end and a second inner perimeter inwardly disposed away from the end;

a first connection bore intermediate the first and second outer perimeters extending through the second arm to a location intermediate the first and second inner perimeters along the second arm;

and a second top rail selected from one of first and second options, said second top rail having an outer perimeter and a bore at an end with an inner perimeter and a second connection bore extending through the second top rail from the inner to the outer perimeter near the end, with one of (a) the inner perimeter of the top rail over at least a portion of the second arm and connected to the second arm with the first connection bore aligned with the second connection bore thereby assisting in connecting the top rail to the second arm when installed with the first option and (b) the outer perimeter of the top rail received in at least a portion of the bore and connected to the second arm with the first connection bore aligned with the second connection bore thereby assisting in connecting the top rail to the second arm when installed with the second option; wherein said top rail has a swing connected to and depending therefrom.

7. The swing set connector and top rail combination of claim 6 wherein the swing set connector further comprises a second forward sleeve portion assisting in defining the forward support receiving bore, and a second rear sleeve portion assisting in defining the rear support receiving bore.

8. The swing set connector and top rail combination of claim 7 wherein the first and second arms are detachably connected together.

9. The swing set connector and top rail combination of claim 8 further comprising a second gusset integrally connected to the second forward sleeve portion, the second rear sleeve portion, and the second arm.

10. The swing set connector and top rail combination of claim 7 wherein the first and second forward sleeve portions connect to form the forward support receiving bore and the first and second rear sleeve portions connect to form the rear support receiving bore.

11. The swing set connector and top rail combination of claim 10 wherein the swing set connector and top rail are provided in a kit with front and rear supports.

12. The swing set connector and top rail combination of claim 5 further comprising a third arm opposite the first arm, said third arm connecting to an end support extending initially coplanarly with the first top rail, and then downwardly to a play surface below the swing.

13. The swing set connector and top rail combination of claim 12 wherein the third arm has a bore similarly sized to the bore of the first arm and collinearly disposed relative thereto, said swing set connector also having a third forward sleeve portion assisting in defining the forward support receiving bore, and a third rear sleeve portion assisting in defining the rear support receiving bore.

14. The swing set connector and top rail combination of claim 13 further comprising a third gusset and wherein the third gusset, the third arm, the third forward sleeve portion and the third rear sleeve portion are integrally connected and are detachably connected to the first arm, and the third arm is removed from the first arm and a second cantilevered arm opposite the first cantilevered arm is connected to the first arm, the second arm having a first outer perimeter at an end, a second outer perimeter inwardly disposed away from the end, and a bore extending into the second arm from the end through at least a portion of the second arm, said bore having a first inner perimeter at the end and a second inner perimeter inwardly disposed away from the end;

a shoulder extending radially outwardly by the second outer perimeter at the second arm;

a first connection bore engageable intermediate the first and second outer perimeters along the second al n and engageable intermediate the first and second inner perimeters along the second arm and extending through the second arm;

and a second top rail selected from first and second options is connected to the second arm and has an outer perimeter and a bore at an end with an inner perimeter and a second connection bore extends through the second top rail near the end from the inner to the outer perimeter, with one of (a) the inner perimeter of the top rail over at least a portion of the second arm and connected to the second arm with the first connection bore aligned with the second connection bore thereby assisting in connecting the top rail to the second arm with the end abutting the shoulder when installed with the first option and (b) the outer perimeter of the top rail received in at least a portion of the bore and connected to the second arm with the first connection bore aligned with the second connection bore thereby assisting in connecting the top rail to the second arm when installed with the second option; wherein said top rail has a swing connected to and depending therefrom;

wherein the removal of the third arm and replacement with the second arm extends a combined length of the first and second top rails.

15. A swing set connector in combination with a top rail comprising:

a swing set connector having a first cantilevered arm having a first outer perimeter at an end, a top rail connected directly to the first arm;

one of a cantilevered second arm and third arm detachably connected to the first arm, said one of the second and third arm extending collinearly with the first arm in an opposite direction;

a forward support receiving bore defined at least partially by a first forward sleeve portion, said forward support receiving bore connected to the first arm and extending downwardly relative to the first arm; and a rear support receiving bore defined at least partially by a first rear sleeve portion, said rear support receiving bore connected to the first arm and extending downwardly relative to the first arm; wherein the forward sleeve portion and rear sleeve portion are integrally connected with the first arm wherein the first arm further comprises a second outer perimeter inwardly disposed away from the end, and a bore extending into the first arm from the end through at least a portion of the arm, said bore having a first inner perimeter at the end and a second inner perimeter inwardly disposed away from the end; and the top rail selected from first and second options has an outer perimeter and a bore at an end with an inner perimeter and a second connection bore near the end extending through the first arm, with one of (a) the inner perimeter of the top rail received over at least a portion of the first arm and connected to the first arm with the first connection bore aligned with the second connection bore thereby assisting in connecting the top rail to the first arm when installed with the first option and (b) the outer perimeter of the top rail received in at least a portion of the bore and connected to the first arm with the first connection bore aligned with the second connection bore thereby assisting in connecting the top rail to the first arm when installed with the second option; wherein said top rail has a swing connected to and depending therefrom.

16. The swing set connector and top rail combination of claim 14 wherein the third arm is initially connected to the first arm and is connected to an end support leading away from the swing set connector to a play surface; and after at least temporarily removing the third arm and end support relative to the first arm, connecting a second arm on the swing set connector opposite the first arm and a second top rail to the second arm thereby resulting in a longer top rail length than initially provided.

17. The swing set connector and top rail combination of claim 14 wherein the second arm is initially connected to the first arm and is connected to a second top rail disposed collinearly with the first top rail; and after at least temporarily removing the second arm and second top rail relative to the first arm, and connecting a third arm on the swing set connector opposite the first arm and an end support to the third arm thereby resulting in a shorter total top rail than initially provided.

* * * * *